US006273691B1

(12) United States Patent
Morimoto et al.

(10) Patent No.: US 6,273,691 B1
(45) **Date of Patent: *Aug. 14, 2001**

(54) SCROLL GAS COMPRESSOR HAVING ASYMMETRIC BYPASS HOLES

(75) Inventors: Takashi Morimoto, Nagaokakyo; Sadayuki Yamada, Otsu; Shuichi Yamamoto, Otsu; Kiyoshi Sawai, Otsu; Taisei Kohayakawa, Otsu; Shozo Hase, Hikone; Hiromasa Ashitani, Otsu, all of (JP)

(73) Assignee: Matsushita Electric Industrial Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/895,998

(22) Filed: Jul. 17, 1997

(30) Foreign Application Priority Data

Jul. 22, 1996 (JP) ..... 8-191895

(51) Int. Cl.[7] ..... F04C 18/04; F04C 27/00

(52) U.S. Cl. ..... 418/15; 418/55.1; 418/55.2; 418/55.4

(58) Field of Search ..... 418/15, 55.1, 55.4, 418/55.2

(56) References Cited

U.S. PATENT DOCUMENTS

| | | | | |
|---|---|---|---|---|
| 4,389,171 | * | 6/1983 | Eber et al. | 418/15 |
| 4,818,195 | * | 4/1989 | Murayama et al. | 418/15 |
| 5,427,513 | * | 6/1995 | Yamada et al. | 418/55.4 |
| 5,674,058 | * | 10/1997 | Matsuda et al. | 418/15 |

FOREIGN PATENT DOCUMENTS

| | | | | |
|---|---|---|---|---|
| 2-86979 | * | 3/1990 | (JP) | 418/55.2 |
| 2-245490 | * | 10/1990 | (JP) | 418/55.2 |
| 3206385 | * | 9/1991 | (JP) | 418/55.4 |
| 4-136492 | * | 5/1992 | (JP) | 418/55.2 |
| 5-113181 | * | 5/1993 | (JP) | 418/55.2 |

* cited by examiner

*Primary Examiner*—John J. Vrablik
(74) *Attorney, Agent, or Firm*—Parkhurst & Wendel, L.L.P.

(57) ABSTRACT

It is an object of the present invention to improve the efficiency of a scroll gas compressor by operating a bypass at a proper compression ratio. To achieve the object, the present invention is constituted so that at least one pair of bypass holes whose one ends are opened in a compression chamber currently performing compression nearby a discharge vent and whose other ends communicate with a discharge chamber are asymmetrically arranged on a panel board. This structure makes it possible to improve the efficiency of the compressor by operating the bypass at an optimum compression ratio even if a difference is observed between pressure rises of a pair of symmetric compressed spaces under the compression process.

3 Claims, 10 Drawing Sheets

$\alpha° \neq \beta°$

SCROLL GAS COMPRESSOR HAVING ASYMMETRIC BYPASS HOLES

FIELD OF THE INVENTION

The present invention relates to a bypass of a scroll gas compressor.

BACKGROUND OF THE INVENTION

In the case of a scroll gas compressor provided with low-vibration and low-noise characteristics, a suction chamber is present at the outer boundary of a swirl for forming a compressed space and the discharge port is provided for the center of the swirl. Moreover, the scroll gas compressor has a characteristic that the compression ratio is constant so that the volume ratio determined between the volume at completion of suction and the volume at completion of compression becomes constant.

Therefore, when the suction pressure and the discharge pressure are almost constant, a high efficiency can be realized by optimizing a set compression ratio.

When variable-speed motion is performed or air-conditioning load fluctuates by using the scroll gas compressor as a refrigerant compressor for air conditioning, the suction pressure and discharge pressure of the refrigerant are changed. Then, insufficient compression or excessive compression occurs due to the difference between actual compression ratio and set compression ratio.

In the case of insufficient compression, the high-pressure refrigerant gas in a discharge chamber intermittently flows backward from a discharge port to a compression chamber to cause the input to increase. In the case of excessive compression, compression power more than necessary power is required. As means for reducing excessive compression, it is known to form a bypass hole. A scroll gas compressor provided with the above bypass hole is disclosed in JP B8-30471.

To optimize the efficiency by the scroll gas compressor provided with the bypass hole as described above, it is necessary that the bypass hole makes the compression chamber communicate with the discharge chamber at an equal compression ratio in a pair of symmetric compressed spaces formed by the engagement between fixed and revolving scrolls.

For example, when manufacturing a fixed scroll with a casting and a revolving scroll with an aluminum alloy, a difference may be observed between scroll wrap shapes due to a difference between thermal expansion coefficients because the temperature of a scroll wrap portion rises during operation. When this phenomenon occurs, the gap between scroll wraps during operation changes, a difference occurs between leak gaps under the compression process, and a difference is observed between pressure rises under the compression process also in a pair of symmetric compressed spaces. Bypass holes are symmetrically arranged in general. When symmetrically arranging the bypass holes, however, the bypass holes communicate with each other at a point where a compression ratio differs in a pair of compressed spaces. To optimize the efficiency, it is necessary to make bypasses communicate with each other at an equal compression rate in a pair of symmetric compressed spaces.

Also in the case of a structure in which a spiral sealing member is set to the front end of a revolving scroll, a difference may be observed between compression rises under the compression process in a pair of symmetric compressed spaces. Therefore, the same consideration is necessary.

JP B8-30471 discloses the position of a bypass hole to optimize the efficiency but the positional relation between bypass holes in a pair of symmetric compressed spaces is not specified.

It is conventional to form a fixed scroll of a cast material to improve its durability, and to form a revolving scroll of an aluminum alloy to reduce its centrifugal force. However, there is a substantial difference in thermal expansion coefficient between a cast material and an aluminum alloy. Therefore, the wrap form differs from the revolving scroll to the fixed scroll, when they are operated and thus heated. As shown in FIG. 4, the compression chambers differ from each other in the degree of sealing effect. In the conventional devices, the bypass holes do not function optimally under such conditions. The main object of the present invention is, therefore, to solve these problems by providing asymmetrical arrangement of the bypass holes.

DISCLOSURE OF THE INVENTION

It is an object of the present invention to operate a bypass at an optimum compression ratio and optimize the efficiency by asymmetrically forming bypass holes in a pair of symmetric compressed spaces by a scroll gas compressor.

The invention for solving the above problem is constituted by forming a fixed scroll and a revolving scroll with different materials and asymmetrically arranging at least one pair of bypass holes whose one ends are opened in a compression chamber currently performing compression nearby a discharge port and whose other ends communicate with a discharge chamber on a panel board.

By using the above structure, it is possible to operate a bypass at an optimum compression ratio and optimize the efficiency even when a difference is observed between pressure rises under the compression process in a pair of symmetric compressed spaces.

Furthermore, when the operating compression ratio is smaller than the set compression ratio, it is possible to operate a bypass at an optimum position in a pair of compression chambers, prevent excessive compression by discharging some of gas currently compressed to the discharge chamber, reduce the compression input, and prevent the compressor from being damaged.

Furthermore, according to the above structure, it is possible to constitute a fixed scroll with a casting and a revolving scroll with an aluminum alloy, improve the friction and abrasion resistances of the scrolls on a slide surface, decrease the mass of the revolving scroll, and reduce the centrifugal force.

The invention in a second embodiment is constituted by loosely setting a spiral sealing member to a spiral groove provided for the front end of a revolving scroll and asymmetrically arranging at least one pair of bypass holes whose first ends are opened in a compression chamber currently performing compression nearby a discharge port and whose second ends communicate with a discharge port on a panel board.

According to the above structure, when the operating compression rate is larger than a set compression rate, it is possible to accelerate the discharge of some of the gas in the compression chamber to the discharge chamber immediately before the opening of the discharge port, control excessive compression when discharging the gas from the discharge port, and decrease the compression input.

Moreover, when the operating compression ratio is smaller than the set compression ratio, it is possible to operate a bypass at an optimum position in a pair of compression chambers, prevent excessive compression by discharging some of gas currently compressed to the discharge chamber, reduce the compression input, and prevent the compressor from being damaged.

The invention in a third embodiment is constituted by forming a bypass hole into a shape and dimension so that either wall forming a sealing member or the sealing member and a spiral groove can fully close the bypass hole. This structure makes it possible to prevent gas from leaking to a compression chamber adjacent to the bypass hole, spiral groove, and sealing member and further improve the compression effect.

The invention in a fourth embodiment is constituted by forming a bypass hole at a position where a compression chamber closest to a discharge port can communicate with the discharge port while the chamber communicates with the bypass hole. According to the above structure, when the operating compression ratio is larger than a set compression ratio, it is possible to acclerate the discharge of some of the gas in the compression chamber to the discharge chamber immediately before opened at the discharge port, control excessive compression when discharging the gas from the discharge port, and decrease the compression input.

DESCRIPTION OF THE EMBODIMENTS

The preferred embodiments of the present invention are described below by referring to the accompanying drawings.

[Embodiment 1]

Figure 2:
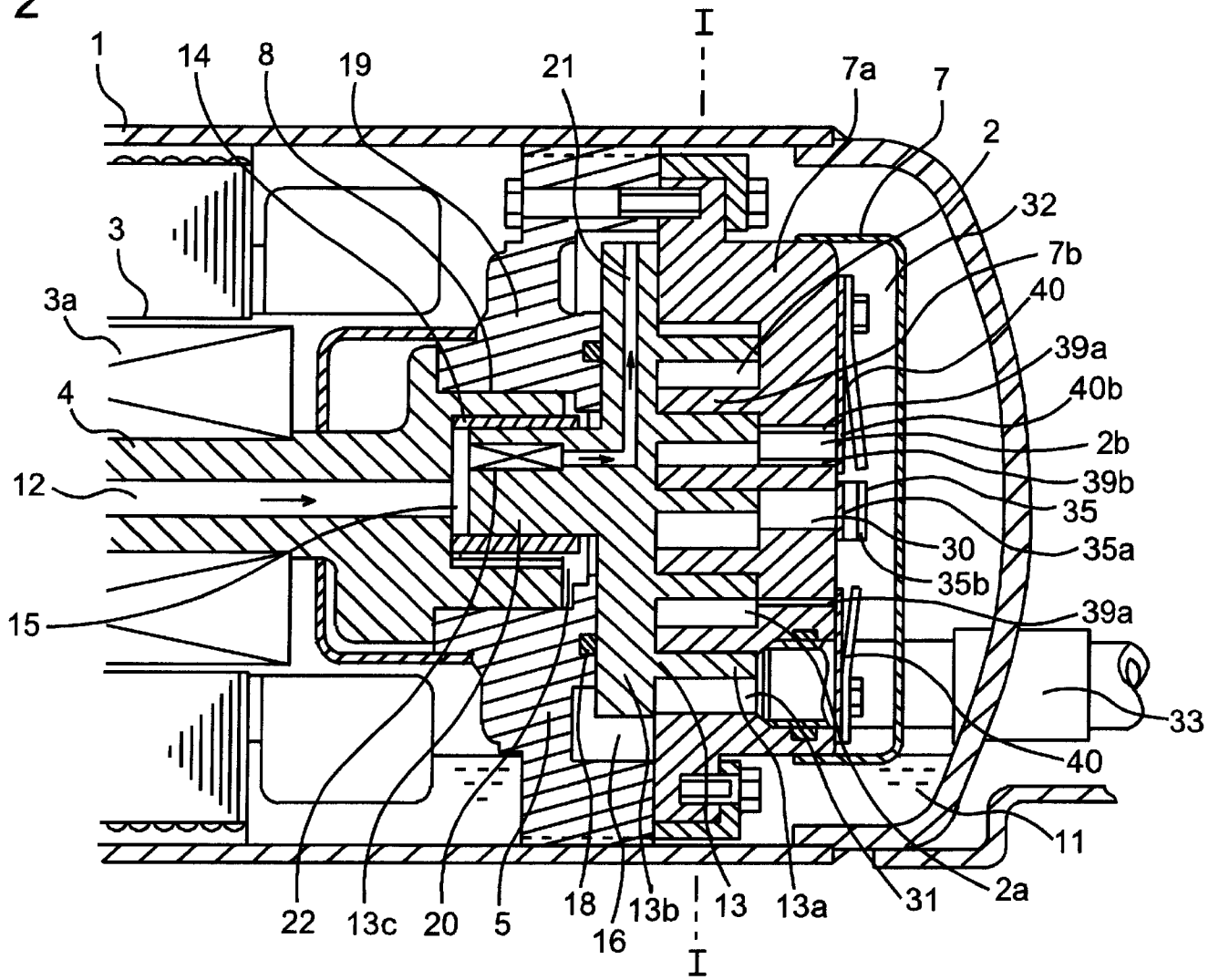
FIG. 2 is a sectional view of an essential portion of the embodiment of the scroll gas compressor in FIG. 1.

FIG. 2 shows a local longitudinal sectional view of a horizontal-type scroll gas compressor, in which the whole inside of a closed vessel 1 made of iron is brought into a high-pressure state and the vessel 1 communicates with a discharge pipe (not illustrated). A motor 3 is set at the center, a compressing section is set at the right, and a body frame 5 of the compressing section supporting one end of a driving shaft 4 secured to a rotor 3*a* of the motor 3 is secured to the closed vessel 1. A fixed scroll 7 is set to the body frame 5.

In the case of an oil hole 12 formed on the driving shaft 4 in the spindle direction, its one end communicates with a lubrication pump system (not illustrated) and its other end finally communicates with a spindle bearing 8. A revolving scroll 13 combined with the fixed scroll 7 to form a compression chamber 2 comprises a spiral revolving scroll wrap 13*a* and a wrap support disk 13*b* provided for one end of a pivot 13*c* and is set between the fixed scroll 7 and the body frame 5.

The fixed scroll 7 comprises a panel board 7*a* and a spiral fixed-scroll wrap 7*b*, and a discharge port 30 is formed at the central portion of the fixed-scroll wrap 7*b* and a suction chamber 31 is formed on the outer boundary. The discharge port 30 communicates with a high-pressure space in which the motor 3 is set through an adjacent discharge chamber 32. The suction chamber 31 communicates with a suction tube 33 passing through the end wall of the closed vessel 1.

A revolving bearing 14 deviated from the spindle of the driving shaft 4 and set to the right-end hole portion of the driving shaft 4 is constituted so as to slide by engaging with the pivot 13*c* of the revolving scroll 13. A very small gap capable of forming an oil film is provided between the wrap support disk 13*b* of the revolving scroll 13 and a thrust bearing 19 provided for the body frame 5. An annular sealing member 18 almost concentric with the pivot 13*c* is set to the wrap support disk 13*b* and the annular sealing member 18 separates a back chamber 20 inside of the member 18 from the outside.

The back chamber 20 communicates with the adjacent spindle bearing 8 and also communicates with the oil hole 12 of the driving shaft 4 through the slide surface of the revolving bearing 14. An oil chamber 15 at the bottom of the revolving bearing 14 communicates with a back chamber 16 in the outer boundary space of the wrap support disk 13*b* through an oil channel 21 provided for the wrap support disk 13*b*. The oil channel 21 has a throttling section 22 at its other end.

The back chamber 16 communicates with the suction chamber 31 through an oil groove 50 (refer to FIG. 1) provided for the surface of the panel board 7*a* slidably contacting with the wrap support disk 13*b*. A check valve 35 for opening or closing the outlet of the discharge port 30 is set on the plane of the panel board 7*a* of the fixed scroll 7 and the check valve 35 comprises a reed valve 35*a* made of a thin steel plate and a valve guard 35*b*.

A pair of first bypass holes 39*a* and a pair of second bypass holes 39*b* which make a second compression chamber 2*b* communicate with the discharge chamber 32 and in which an opening to the second compression chamber 2*b* is smaller than the thickness of the revolving-scroll wrap 13*a* are asymmetrically arranged at the central portion of the panel board 7*a* so as to follow the compression forwarding direction along the wall surface of the revolving-scroll wrap 13*a*. A bypass valve system 40 for opening or closing the outlet side of the first bypass holes 39*a* and second bypass holes 39*b* is set on the panel board 7*a*.

Figure 1:
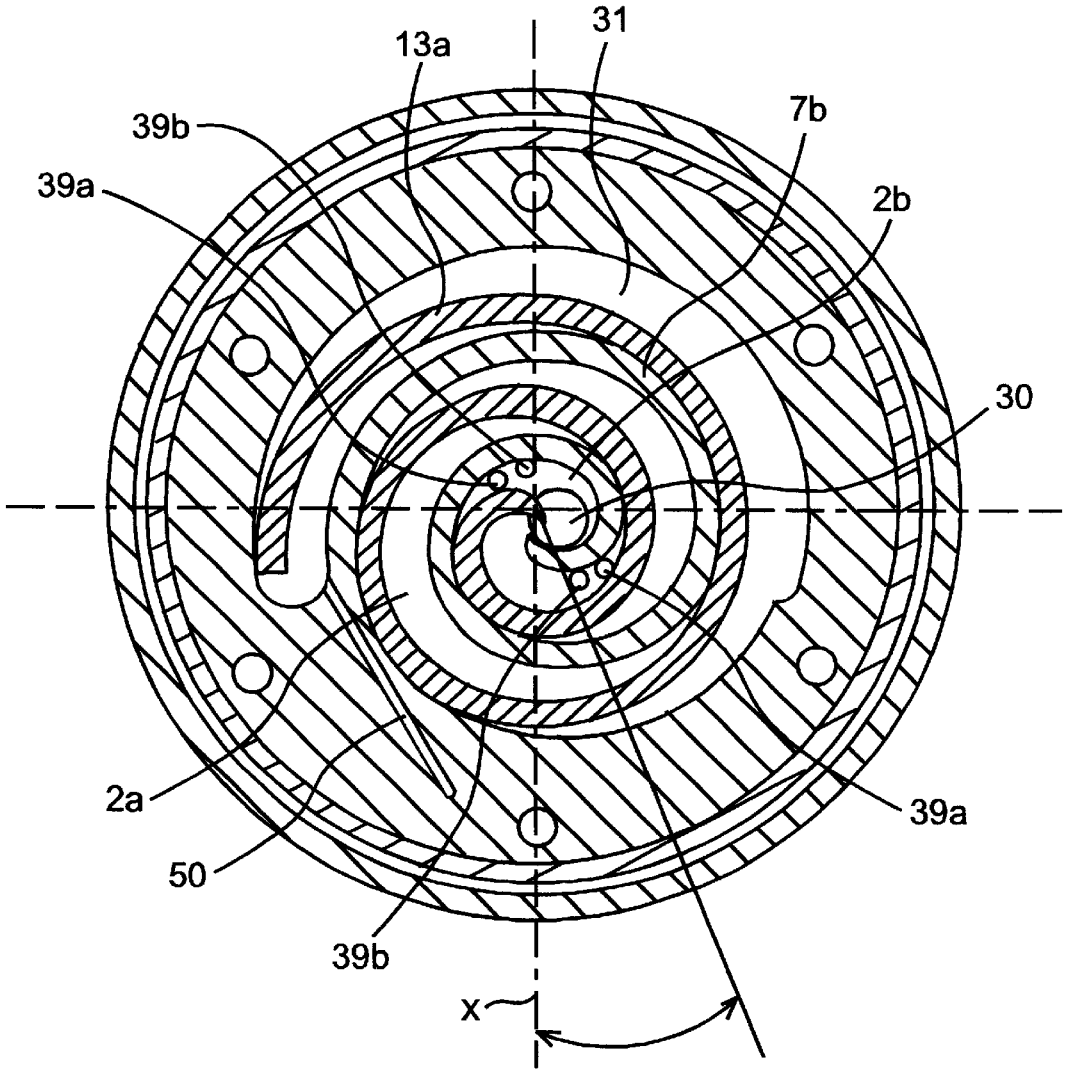
FIG. 1 is a sectional view of an embodiment of the scroll gas compressor showing embodiment 1 of the present invention.

FIG. 1 is an illustration showing the cross section along the line 1—1 in FIG. 2, showing the state of a compressed space immediately before the second compression chamber 2*b* intermittently communicating with the discharge port 30 communicates with the discharge port 30. The first bypass holes 39*a* and second bypass holes 39*b* are asymmetrically arranged.

In particular, the asymmetrical arrangement of the bypass holes 39*a* and 39*b* can be better understood by noting that, for example, hole 39*b* (shown located in the lower half of FIG. 1), is positioned angularly offset from a diametrical center line X, while the other hole 39*b* (shown located in the upper half of FIG. 1) is positioned substantially along the centerline X. In this manner, bypass holes 39*a* and 39*b* forming one pair (shown in upper half of FIG. 1) are asymmetrical relative to the respective holes 39*a* and 39*b* forming the other pair (shown in lower half of FIG. 1). Each of the holes 39*a* and 39*b* is open to second compression chamber 2*b* near the outlet of discharge port 30. The holes 39*a* and 39*b* (shown located in either upper half or lower half of FIG. 1) are positioned close to each other in a circumferential direction to be closed substantially simultaneously by revolving scroll wrap 13*a*.

Figure 3:
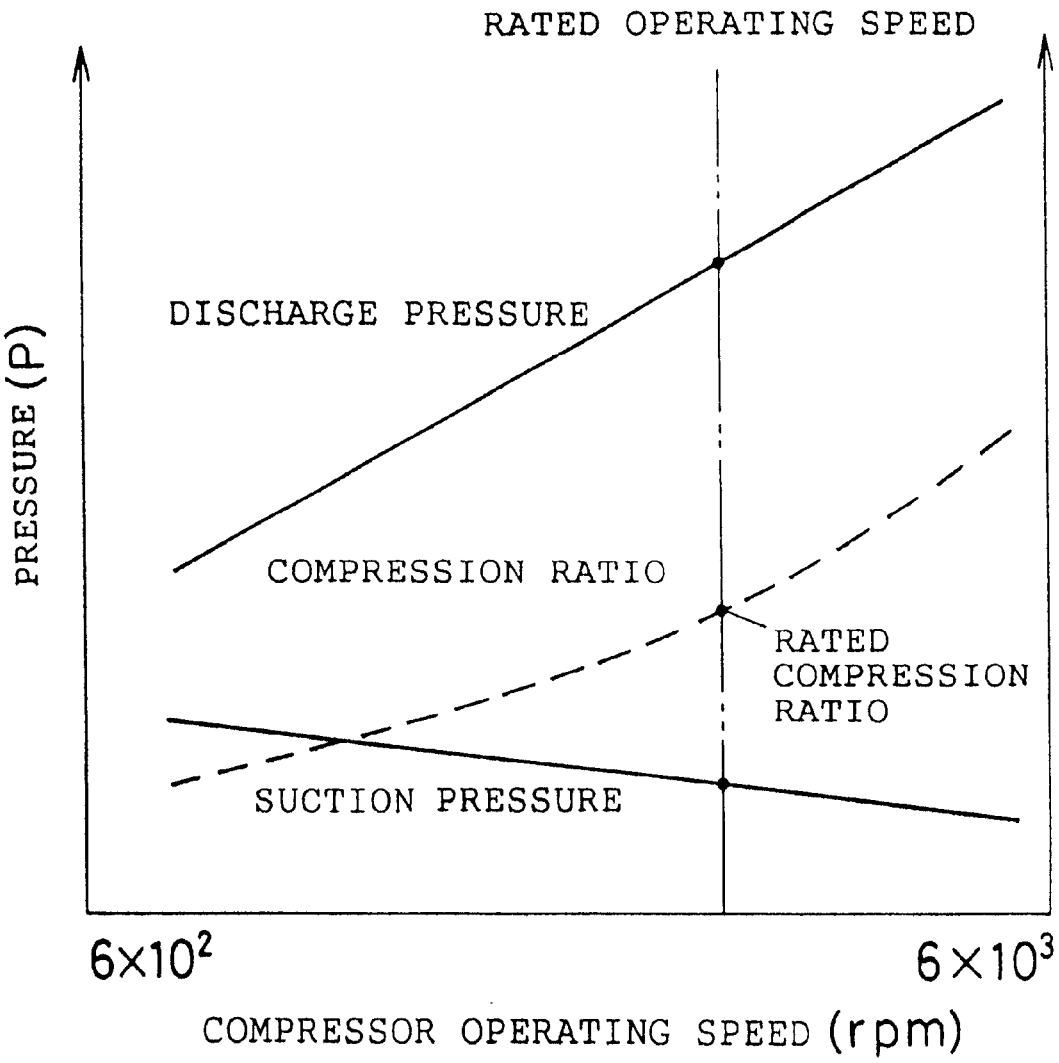
FIG. 3 is a characteristic diagram showing the relation between compressor operating speed and pressure.

FIG. 3 is an illustration showing actual load characteristics about the relation between compressor operating speed, suction pressure, discharge pressure, and compression ratio when operating an air conditioner by assigning compressor operating speed to the horizontal axis and pressure and compression ratio to the vertical axis.

Figure 4:
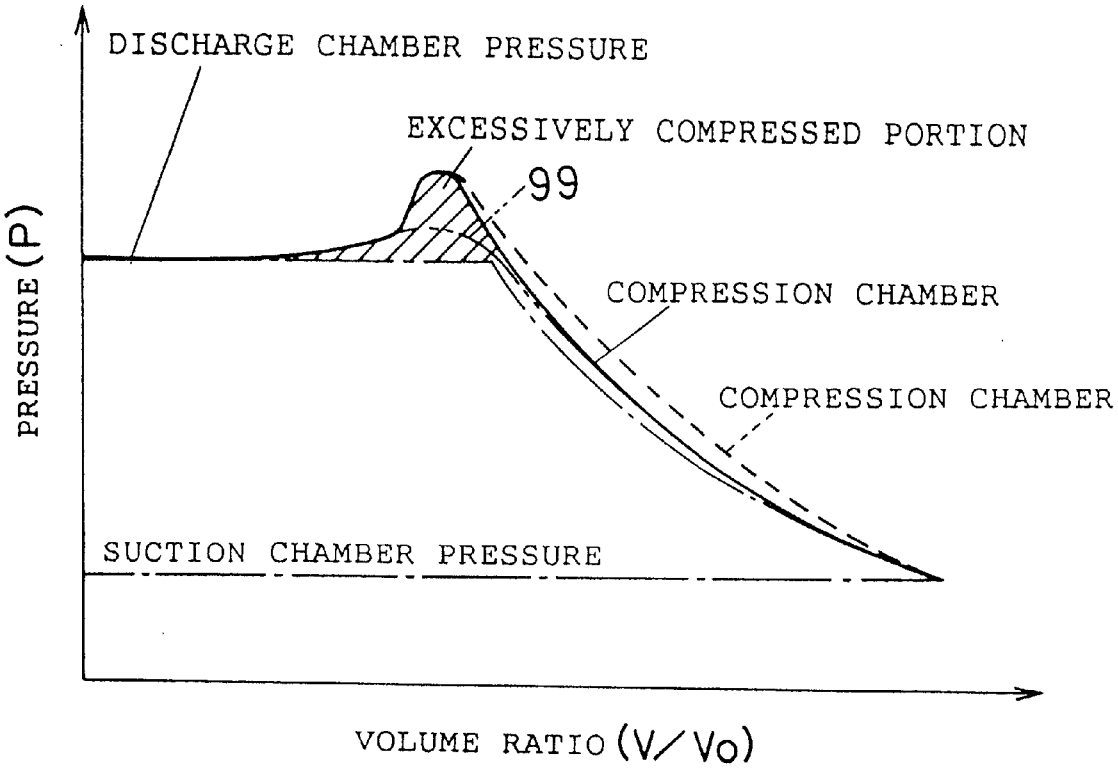
FIG. 4 is a characteristic diagram showing volume-change and pressure-change states of a compression chamber.

FIG. 4 shows a P-V diagram of a conventional scroll gas compressor by assigning volume change of a compression chamber to the horizontal axis and pressure change of the compression chamber to the vertical axis.

In the case of the structure of the above scroll gas compressor, when the driving shaft 4 is rotated by the motor 3, the revolving scroll 13 supported by the thrust bearing 19 of the body frame 5 rotates, and thereby suction refrigerant gas containing lubricant enters the suction chamber 31 from the refrigerant cycle connected to the compressor via the suction tube 33, compression-transferred to the compression chamber 2 formed between the revolving scroll 13 and the fixed scroll 7, and discharged to the outside of the compressor from a discharge pipe (not illustrated) while cooling the motor 3 through the discharge port 30 and discharge chamber 32 at the central portion. The compressed refrigerant gas flows from discharge port 30 through discharge chamber 32 to motor 3 and is then discharged to the outside of the compression chamber from a discharge pipe. The temperature of motor 3 decreases because the refrigerant gas absorbs heat from the motor prior to being discharged to the outside of the compression chamber. This absorption of heat cools motor 3.

The discharged refrigerant gas containing the lubricant is separated in the middle of the passage up to the discharge pipe (not illustrated) from the discharge chamber 32 and collected in an oil tank 11. The lubricant on which a discharge pressure works is sent to the oil chamber 15 by a lubrication pump system (not illustrated) connected to one end of the driving shaft 4 via the oil hole 12 of the driving shaft 4 and most of the lubricant is returned to the oil tank 11 via the slide surface between the revolving bearing 14 and the spindle bearing 8 while remaining lubricant finally enters the back chamber 16 via the oil channel 21 provided for the revolving scroll 13.

The lubricant flowing through the oil channel 21 is primarily decompressed at the throttling section 22 at its inlet and enters the back chamber 16 communicating with the suction chamber 31. The refrigerant-gas pressure of the compression chamber 2 works so as to separate the revolving scroll 13 from the fixed scroll 7 in the spindle direction of the driving shaft 4. Moreover, the wrap support disk 13*b* of the revolving scroll 13 receives back pressure from the back chamber 20 (internal portion enclosed by the annular sealing member 18).

Therefore, the force for separating the revolving scroll 13 from the fixed scroll 7 and the back pressure are offset. As a result, when the back pressure is larger than the separation force of the revolving scroll 13, the wrap support disk 13*b* is supported by the panel board 7*a* of the fixed scroll 7. However, when the back pressure is smaller than the separation force, the disk 13*b* is supported by the thrust bearing 19.

In any case described above, a very small gap is held between the wrap support disk 13*b* and its slide surface, an oil film is formed by the lubricant supplied to the slide surface, and the slide resistance is reduced. Also when the wrap support disk 13*b* of the revolving scroll 13 is supported by any one of the panel board 7*a* of the fixed scroll 7 and the thrust bearing 19, the gap of the compression chamber 2 is very small and closed by an oil film made of the lubricant entering the compression chamber 2 through the back chamber 16 and the suction chamber 31 in order.

Moreover, because the scroll compressor has a constant compression ratio, much refrigerant solution is returned from the refrigeration cycle through the suction tube 33 at the beginning of start of compressor refrigeration and enters the compression chamber 2 to occasionally cause liquid compression and the pressure in the compression chamber 2 to abnormally rise and become higher than the pressure of the discharge chamber 32. When liquid compression occurs in the second compression chamber 2*b* (refer to FIGS. 1 and 2) intermittently communicating with the discharge port 30, the bypass valve 40 for closing the outlet side of the first bypass holes 39*a* and second bypass holes 39*b* provided for the panel board 7*a* opens to discharge the refrigerant to the discharge chamber 32*a* and lower the compression-chamber pressure. The bypass valve 40 opens not only when liquid compression occurs in the compression chamber 2.

That is, as shown in FIG. 3, the suction pressure during the normal refrigeration-cycle operation lowers by following the change of the compressor from low-speed to high-speed operations. However, it is general that the discharge pressure generally rises and the compression ratio increases.

Therefor the compression ratio at low-speed operation of the compressor when the bypass valve 40 is not set becomes smaller than the compression ratio set under rated-load operation state and an excessive compression state occurs as shown by the hatched portion in FIG. 4.

In this case, similarly to the above described, a reed portion 40*b* of the bypass valve 40 for closing the outlet side of the first bypass holes 39*a* and second bypass holes 39*b* opens to discharge the refrigerant to the discharge chamber 32 and thus, the compression-chamber pressure temporarily lowers and the compression load is reduced as shown by the chain line 99.

In general, when the fixed scroll 7 and the revolving scroll 13 are made of different materials, a difference occurs between the sealing degrees of gaps of the compression chamber due to the difference between thermal expansion coefficients and the pressures of the compression chambers 2 (compression chamber A and compression chamber B) symmetrically arranged differ from each other (refer to FIG. 4).

Figure 7:
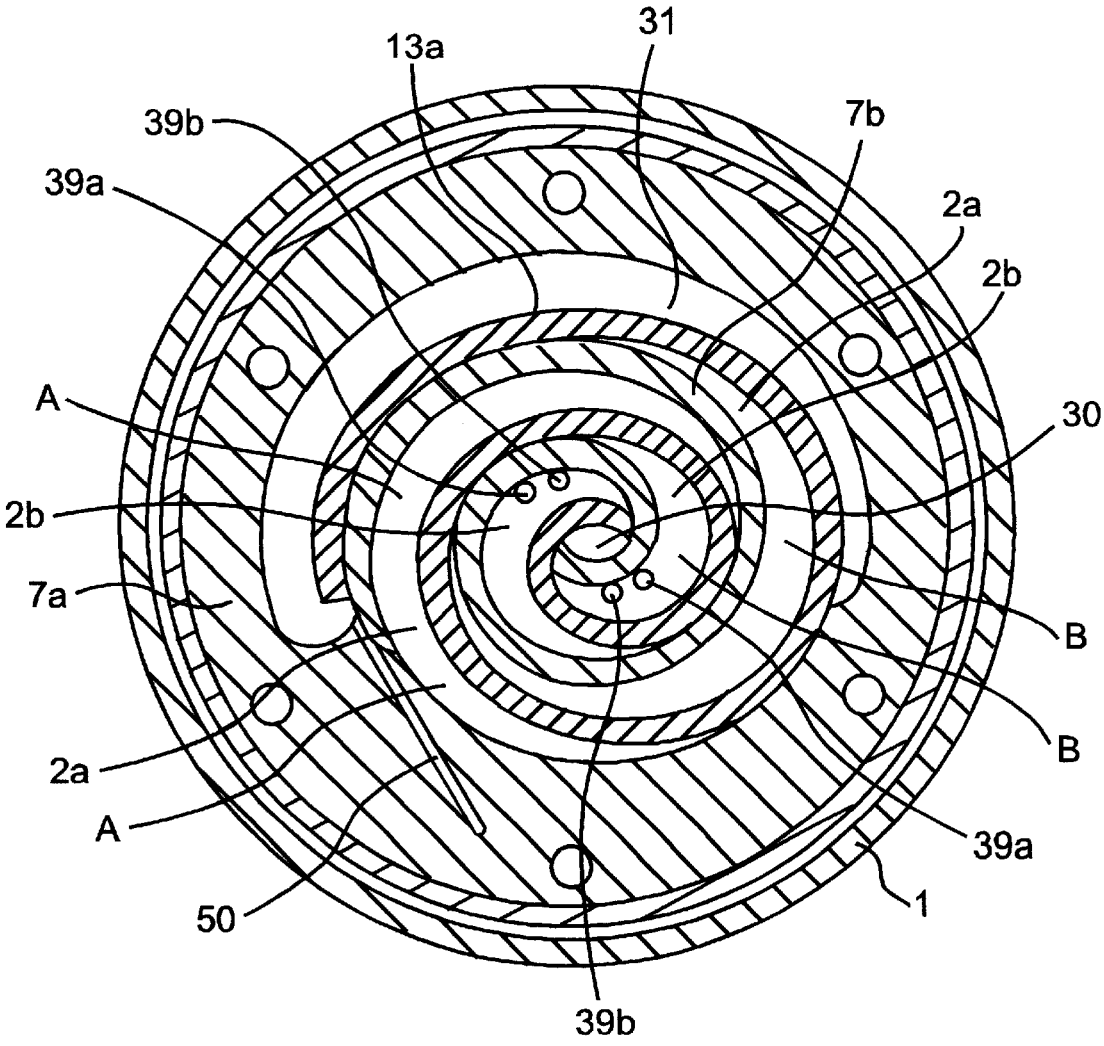
FIG. 7 is a sectional view of an embodiment of the scroll gas compressor showing embodiment 4 of the present invention.

Therefore, to operate bypasses at an equal compression ratio in the compression chambers 2 (compression chamber A and compression chamber B), bypass holes are not symmetrically but asymmetrically arranged (refer to FIG. 1). Unless operating the bypasses at an equal compression ratio, a pressure difference occurs between the compression chambers 2 (compression chamber A and compression chamber B) as shown in FIG. 7. The pressure difference between the compression chambers 2 compression chamber A and compression chamber B) provides a rotation force for the revolving scroll 13 and a torque for a rotation preventive member (not illustrated) of the revolving scroll 13.

However, when the bypass valve 40 opens at an equal compression rate to reduce the compression load, the pressures of the compression chambers 2 (compression chamber A and compression chamber B) instantaneously become a uniform pressure in the middle of the compression process through the discharge chamber 32 and the pressure difference between the compression chambers decreases.

However, because the pressure of the suction chamber 31 lowers and the pressure of the discharge chamber 32 rises at the high-speed operation of the compressor, a compression state (insufficient compression state) occurs in which the compression ratio of the actual refrigeration-cycle operation is larger than the set compression ratio of the scroll compressor and the refrigerant gas in the discharge chamber 32 intermittently flows backward into the second compression chamber 2*b* through the discharge port 30 while the volume of the second compression chamber 2*b* increases and moreover before the check valve system 35 closes the discharge port 30.

The backflow refrigerant gas is recompressed in the second compression chamber 2*b* and brought into an excessively compressed state. Also in this case, similarly to the above described, the bypass valve system 40 is made to open through the first bypass holes 39*a* and second bypass holes 39*b* and excessively-compressed refrigerant gas is discharged to the discharge chamber 32 to lower the compression-chamber pressure.

Because the bypass valve system 40 opens through the first bypass holes 39*a*, the timing of discharging refrigerant gas from the second bypass holes 39*b* to the discharge chamber 32 is accelerated, lowering of the compression-chamber pressure is accelerated, and the excessive-compression loss decreases.

Moreover, because the first bypass holes 39*a* and the second bypass holes 39*b* are arranged at a proper interval, it is possible to shorten the time in which the first bypass holes 39*a* and the second bypass holes 39*b* are simultaneously closed by the revolving-scroll wrap 13*a* and lengthen the effective period of bypass action.

That is, by continuing the bypass action according to the first bypass holes 39*a* and the second bypass holes 39*b*, the pressure change of the second compression chamber 2*b* when the second compression chamber 2*b* communicates with the discharge chamber 32 decreases and the sound of discharge to the discharge chamber 32, sound due to the check valve system 35, and discharge pulsation are reduced.

[Embodiment 2]

Figure 5:
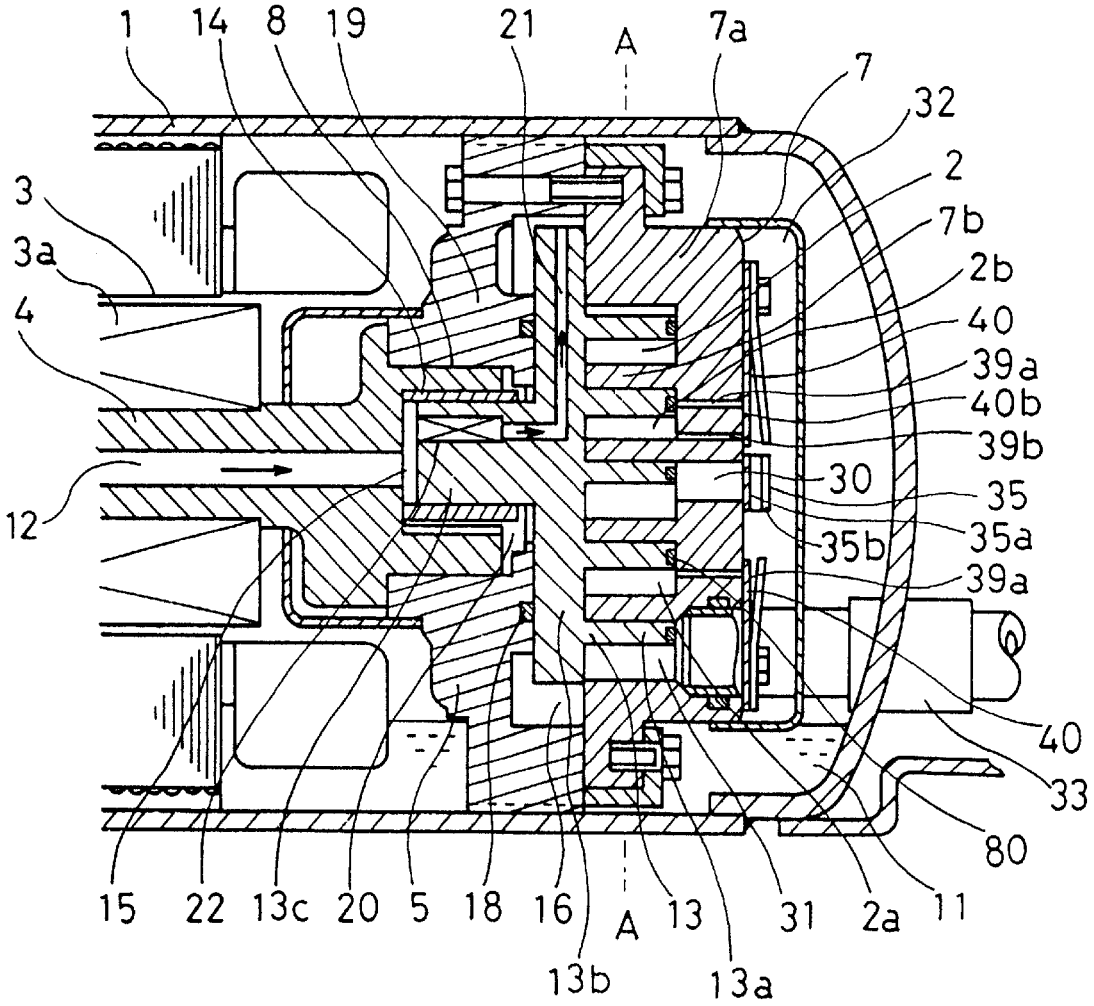
FIG. 5 is a longitudinal sectional view of an embodiment of the scroll gas compressor showing embodiment 2 of the present invention.

FIG. 5 is an illustration showing the state in which a spiral sealing member 80 is set to the front end of a revolving scroll wrap 13*a* in the scroll gas compressor of the embodiment 1.

In the case of the above structure, compression chambers sealed and not sealed by the sealing member are produced in the compression chambers 2 symmetrically arranged in general. In this case, a difference occurs between the sealing degrees of gaps of compression chambers and the pressures of the compression chambers 2 (compression chamber A and compression chamber B) symmetrically arranged differ from each other (refer to FIG. 4). Therefore, to operate bypasses at an equal compression ratio in the compression chambers 2 (compression chamber A and compression chamber B), bypass holes are not symmetrically but asymmetrically arranged (refer to FIG. 2).

[Embodiment 3]

Figure 6:
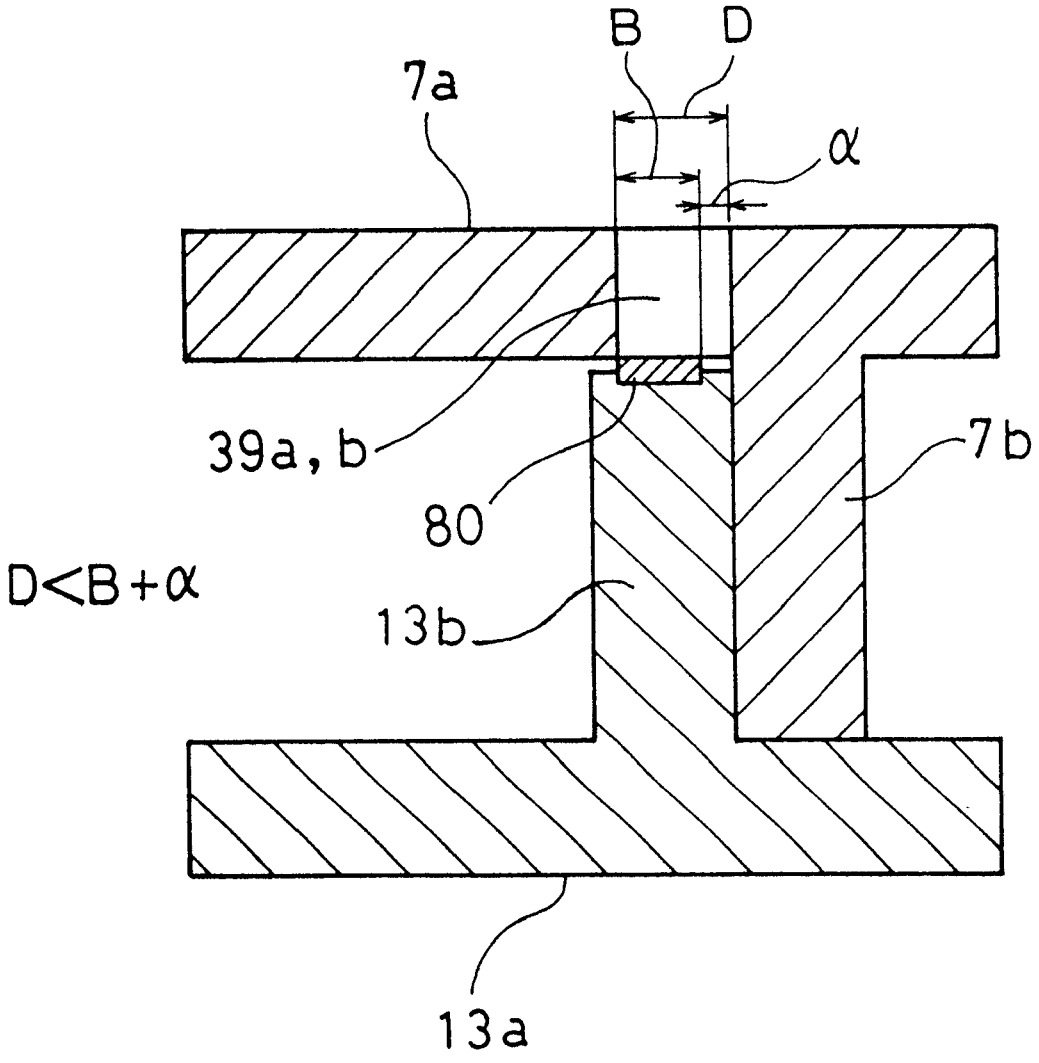
FIG. 6 is an enlarged view of an essential portion of an embodiment of the scroll gas compressor showing embodiment 3 of the present invention.

FIG. 6 is an illustration showing the shapes and dimensions of a pair of first bypass holes 39*a* and a pair of second bypass holes 39*b* in FIG. 5.

The shapes and dimensions are determined so that the spiral sealing member 80 and one of the walls forming a spiral groove can fully close the bypass holes 39*a* and 39*b*.

Moreover, it is possible to use a structure having shapes and dimensions by which the spiral sealing member 80 can fully close the bypass holes 39*a* and 39*b*.

[Embodiment 4]

FIG. 7 shows the state of a compressed space when the revolving scroll wrap 13*a* in FIG. 2 further advances.

In this case, the first bypass holes 39*a* and the second bypass holes 39*b* are formed so that the compression chamber 2 closest to the discharge port 30 can communicate with the discharge port 30 while the chamber 2*b* communicates with the first bypass holes 39*a* and the second bypass holes 39*b*.

Figure 8:
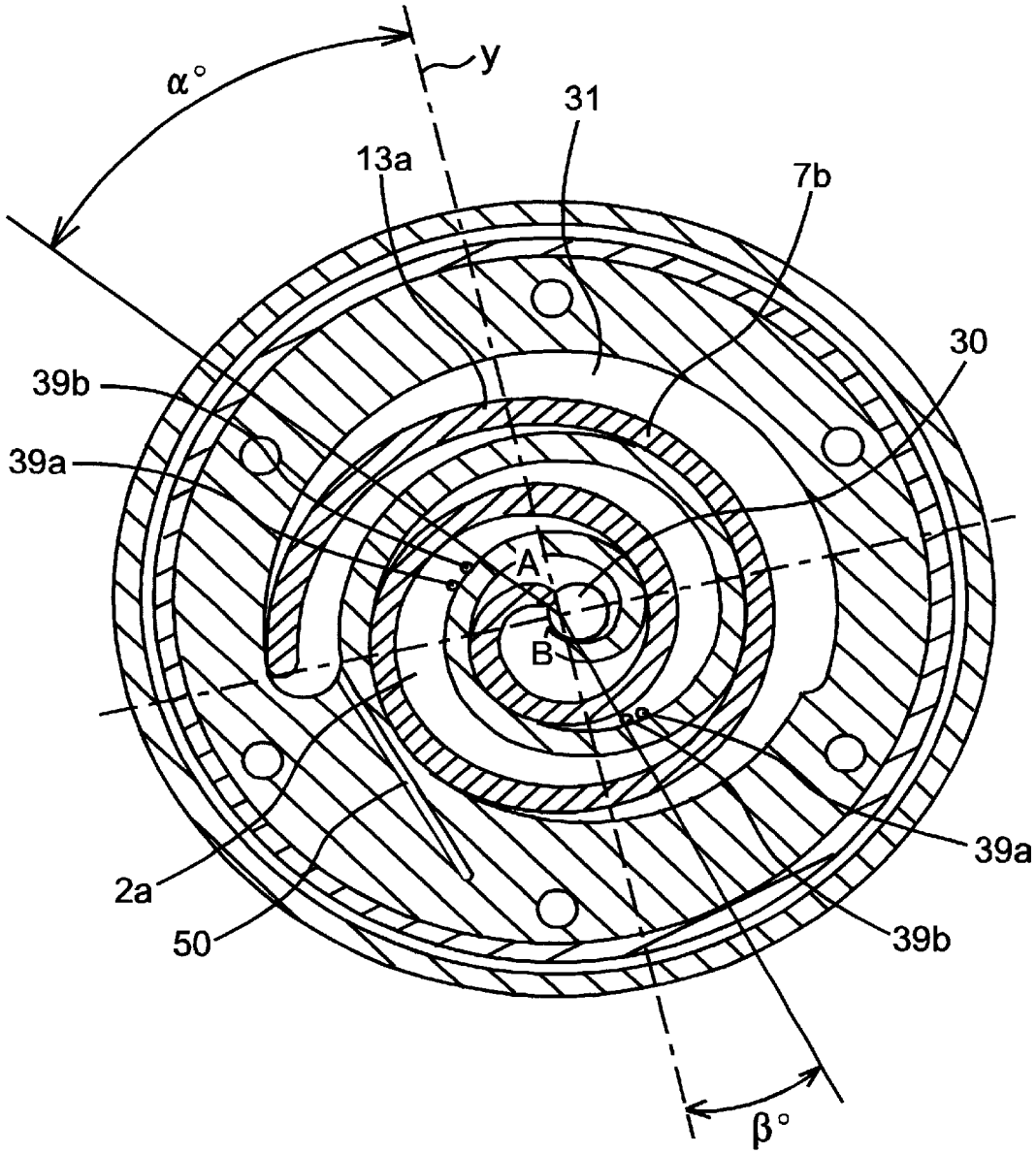
FIG. 8 is similar to FIG. 1 and shows the asymmetrical arrangement of the bypass holes.

FIG. 8 depicts the asymmetrical arrangement of bypass holes 39*a* and 39*b* about the center of the panel board, similar to FIG. 1, but in a slightly modified manner in that the positions of the respective bypass holes are varied by about 180°. For example, holes 39*b* are asymmetrically arranged at angles $\alpha°$ and $\beta°$, relative to a diametrical line 'y' passing through the center of the panel board 7*a*. And, holes 39*a* would have a similar angular relationship relative to each other.

The pressure rise curves of compression chambers A and B, shown in FIG. 4, may be inverted depending upon the relationship between revolving scroll 13 and fixed scroll 7, depending upon which thermal expansion coefficient is larger or smaller. When a compression chamber has an increased gap surrounded by the wrap on the inner side of revolving scroll 13, for example, compression chamber A (which establishes the relationship of this chamber) corresponds to the compression chamber B, shown in FIG. 4.

Figures 9, 10, 11, 12:
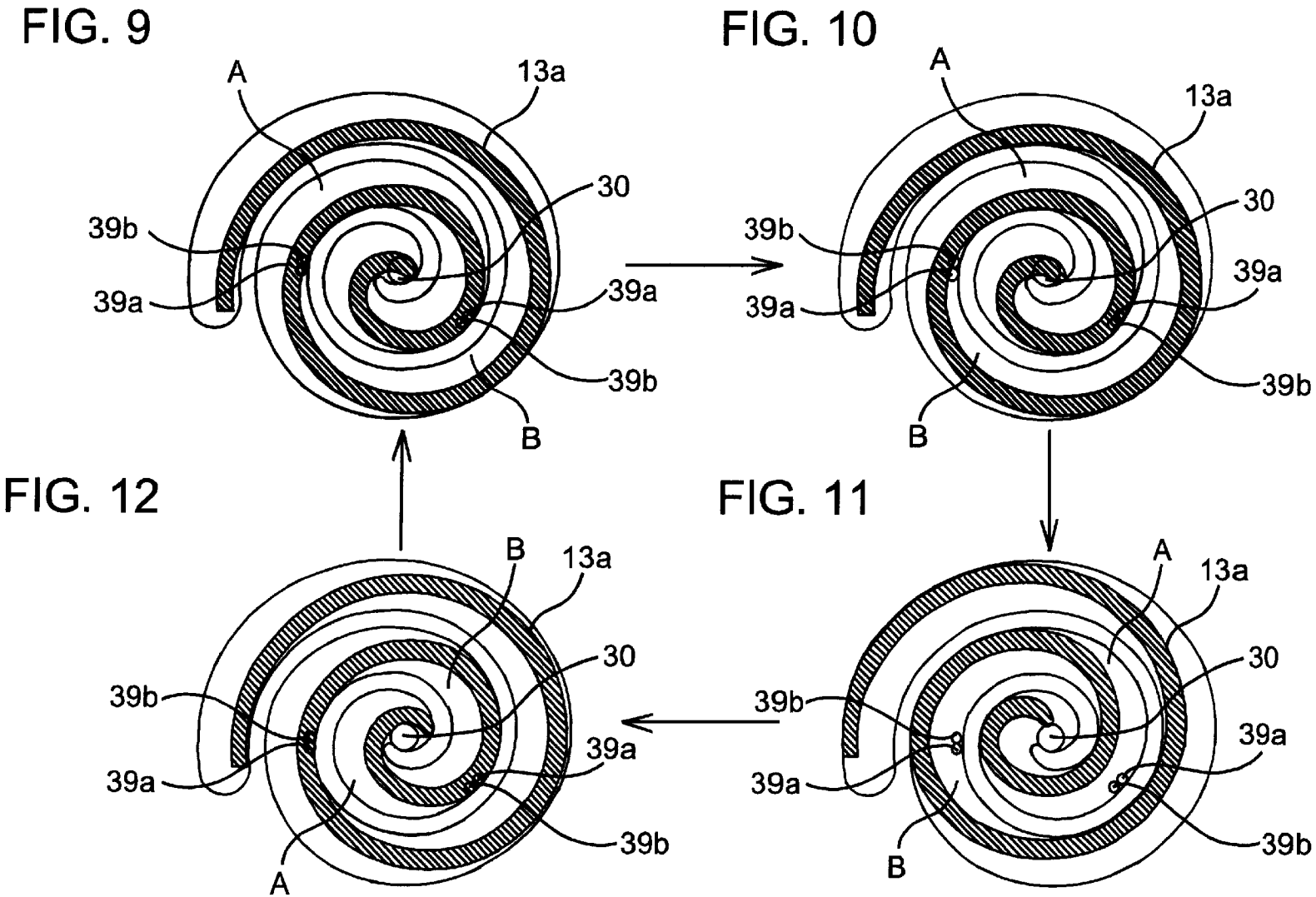
FIGS. 9–12 are similar to FIG. 1 and illustrate the relationship between the position of the bypass holes and the revolving scroll as the revolving scroll crank advances when a scroll compressor is operated under excessive compression conditions.

FIGS. 9–12 illustrate an advancing process of the scroll crank, on the assumption that the scroll compressor is operated in an over-compressed state or under excessive compression conditions. FIG. 9 shows the pair of compression chambers of FIG. 4, wherein compression chamber B, wherein the internal pressure rises faster than in chamber A, starts to communicate with a pair of bypass holes 39*a* and 39*b*. At this point, if the pressure of the compression chamber B is higher than the discharge pressure, the excessively compressed gas is discharged from chamber B through the bypass holes. Also, at this point, the compression chamber A is not yet excessively compressed, and the bypass holes in compression chamber A do not yet communicate with the bypass holes.

In FIGS. 10 and 11, revolving scroll 13 advances further, and even the compression chamber A, which is slower in pressure rise, becomes excessively compressed, and the excessively compressed gas begins to be discharged from chamber A through the bypass holes 39*a* and 39*b*. In FIG. 12, the excessive compression in chamber B, which communicates with the bypass holes before chamber A, is discharged completely, while the excessive compression in chamber A is still in the process of being discharged. In this manner, the configurations of FIGS. 1 and 8, showing the asymmetrical arrangement of the bypass holes, enable the bypass holes to operate at optimum positions.

Figure 14:
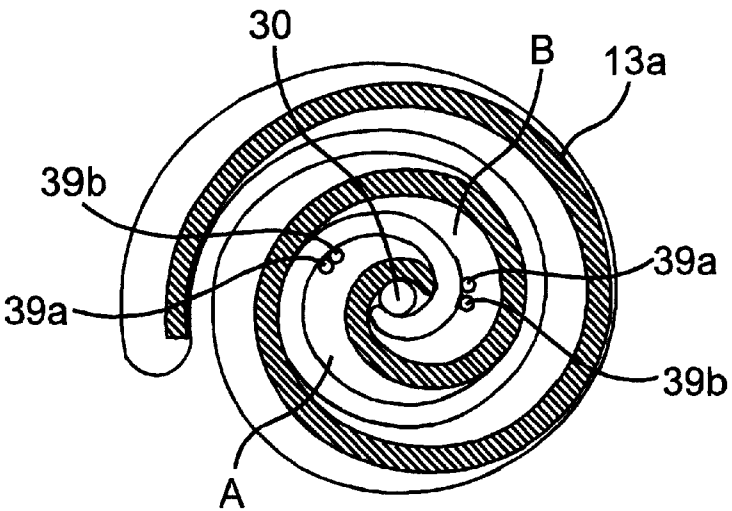
FIGS. 13 and 14 show the first and fourth embodiments of FIGS. 1 and 7, respectively, and illustrate the relationship between chambers A and B and the bypass holes after the compression chamber closest to the discharge port communicates with the discharge port.
Figure 13:
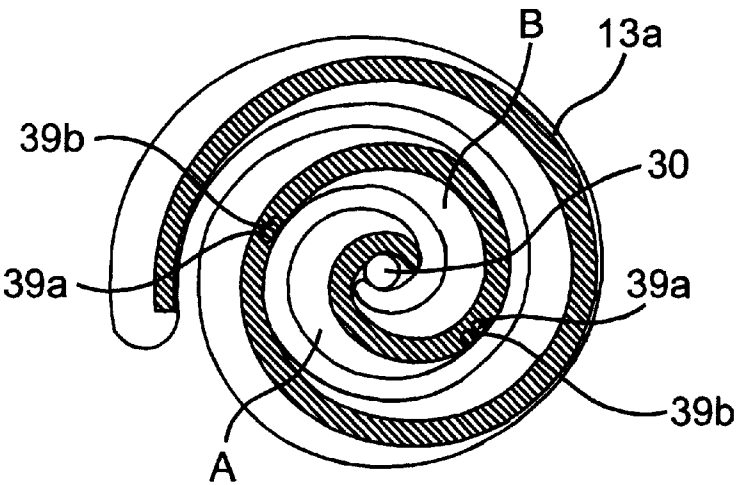

FIG. 13 shows the state immediately after a compression chamber positioned closest to a discharge port communicates with the discharge port 30, according to Embodiment 1. In this situation, both compression chambers A and B, when in a position closest to the discharge hole 30, do not yet communicate with the bypass holes 39*a* and 39*b*. According to Embodiment 1, when the operation is carried out in a short-of-compression, or insufficient compression state where no excessive compression is produced, the discharge gas is discharged only from discharge port 30. However, according to Embodiment 4, shown in FIG. 14, immediately after the compression chamber closest to the discharge port 30 communicates with the discharge port in the same manner as Embodiment 1, both compression chambers A and B remain in communication with bypass holes 39*a* and 39*b*. Therefore, if the operation is carried out in a short-of-compression, or insufficient compression state, the discharge gas can be discharged from both discharge port 30 and bypass holes 39*a* and 39*b*, producing an effect similar to that when the diameter of the discharge hole is enlarged. Thus, according to Embodiment 4, any discharge resistance caused by operation in a short-of-compression (or insufficient compression) state is reduced, thereby achieving high efficiency.

What is claimed is:

1. A scroll gas compressor comprising:

a spiral fixed scroll wrap on one side of a panel board serving as a part of a fixed scroll is engaged with a revolving scroll wrap on a wrap support disk serving as a part of a revolving scroll and having a shape similar to said fixed scroll forming a pair of spiral symmetric compression spaces between the two scrolls;

a discharge port communicating with a discharge chamber for the central portion of said fixed scroll wrap;

a suction chamber for the outside of said fixed scroll wrap;

a scroll compression mechanism comprising a plurality of divided compression chambers in which each compression space is continuously movable toward a discharge side from a suction side and its volume varies to compress a fluid when said revolving scroll revolves around said fixed scroll through a rotation preventive member;

said fixed scroll and said revolving scroll comprise materials having different thermal expansion coefficients; and said panel board including two pairs of bypass holes, each hole having an end opening into a compression chamber for performing compression near an outlet of said discharge port, and each hole having a second end communicating with said discharge chamber, wherein each of the two pairs of bypass holes includes first and second holes that are asymmetrically arranged with respect to the center of said panel board, and both of the first and second holes of each of the two pairs of bypass holes are closable substantially simultaneously by said revolving scroll wrap.

2. A scroll gas compressor comprising:

a spiral fixed scroll wrap on one side of a panel board comprising a fixed scroll, said fixed scroll wrap being engaged with a revolving scroll wrap on a wrap support disk comprising a revolving scroll and having a shape similar to said fixed scroll forming a pair of spiral symmetric compression spaces between the two scrolls;

said fixed scroll and said revolving scroll comprise materials having different thermal expansion coefficients;

a discharge port communicating with a discharge chamber at a central portion of said fixed scroll warp;

a suction chamber outside of said fixed scroll wrap;

a scroll compression mechanism comprising a plurality of divided compression chambers in which each compression space is continuously movable toward a discharge side from a suction side and whose volume varies to compress a fluid when said revolving scroll revolves around said fixed scroll through a rotation preventive member, a spiral sealing member contacting a spiral recessed groove on the entire length of the front end of said spiral revolving scroll, and at least two pairs of bypass holes, each hole having an end opening into a compression chamber for performing compression near an outlet of said discharge port and each hole having a second end communicating with said discharge chamber, wherein each of the two pairs of bypass holes includes first and second holes that are asymmetrically arranged with respect to the center of said panel board and both of the first and second holes of each of the two pairs of bypass holes are closable substantially simultaneously by said revolving scroll wrap.

3. The scroll gas compressor according to claim 2, wherein said bypass holes are arranged with shapes and dimensions by which either of the walls forming a sealing member or the sealing member and the spiral groove can fully close said bypass holes.

* * * * *